US008319432B2

(12) United States Patent
Jenek et al.

(10) Patent No.: US 8,319,432 B2
(45) Date of Patent: Nov. 27, 2012

(54) CATHODE SHIELDING FOR DEUTERIUM LAMPS

(75) Inventors: Torsten Jenek, Muehlheim (DE); Karsten Ernesti, Hanau (DE); Rolf Malkmus, Hanau (DE)

(73) Assignee: Heraeus Noblelight GmbH, Hanau (DE)

( * ) Notice: Subject to any disclaimer, the term of this patent is extended or adjusted under 35 U.S.C. 154(b) by 0 days.

(21) Appl. No.: 13/139,562

(22) PCT Filed: Nov. 13, 2009

(86) PCT No.: PCT/EP2009/008077

§ 371 (c)(1),
(2), (4) Date: Jun. 14, 2011

(87) PCT Pub. No.: WO2010/069439

PCT Pub. Date: Jun. 24, 2010

(65) Prior Publication Data

US 2011/0266950 A1 Nov. 3, 2011

(30) Foreign Application Priority Data

Dec. 17, 2008 (DE) ..... 10 2008 062 410

(51) Int. Cl.
*H01J 17/16* (2006.01)
*H01J 61/30* (2006.01)

(52) U.S. Cl. .... 313/636; 313/493; 313/634; 313/318.01

(58) Field of Classification Search ..... 313/484, 313/493, 567, 634, 636, 637, 318.01
See application file for complete search history.

(56) References Cited

U.S. PATENT DOCUMENTS

| | | | | |
|---|---|---|---|---|
| 5,684,363 | A | 11/1997 | Ikedo et al. | |
| 5,698,945 | A | 12/1997 | Ikedo et al. | |
| 6,078,132 | A | 6/2000 | Davenport | |
| 6,586,866 | B1 * | 7/2003 | Ikedo et al. | 313/238 |
| 6,741,036 | B1 * | 5/2004 | Ikedo et al. | 313/634 |
| 6,870,317 | B2 | 3/2005 | Ito et al. | |
| 6,873,107 | B2 | 3/2005 | Kawai et al. | |
| 7,271,542 | B2 | 9/2007 | Ito et al. | |

(Continued)

FOREIGN PATENT DOCUMENTS

DE 19901919 A1 7/1999

(Continued)

OTHER PUBLICATIONS

Int'l Search Report Issued on Feb. 18, 2010 in Int'l Application No. PCT/EP2009/008077.

(Continued)

*Primary Examiner* — Anh Mai
*Assistant Examiner* — Kevin Quarterman
(74) *Attorney, Agent, or Firm* — Panitch Schwarze Belisario & Nadel LLP

(57) ABSTRACT

A gas-discharge lamp (deuterium lamp) is provided having a lamp bulb (26) filled with gas, an anode (12) disposed inside the lamp bulb, a cathode (10) spaced from the anode inside the lamp bulb, a housing having a molded body (18), a rear housing wall (24), and a housing base made at least partially of electrically nonconductive material. The housing base includes a housing front (16), an intermediate housing wall (22), a cathode space (28), and a cathode shielding window (20). The cathode shielding window is insulated from the molded body and/or is made of an insulating material. The gas-discharge lamp is particularly applicable for analytical purposes.

9 Claims, 2 Drawing Sheets

U.S. PATENT DOCUMENTS

| | | | | |
|---|---|---|---|---|
| 2002/0011771 | A1 | 1/2002 | Ikedo | |
| 2004/0046506 | A1* | 3/2004 | Kawai et al. | 313/634 |
| 2005/0231119 | A1* | 10/2005 | Ito et al. | 313/634 |
| 2007/0257618 | A1 | 11/2007 | Ueno et al. | |
| 2007/0296338 | A1 | 12/2007 | Ito et al. | |
| 2008/0143232 | A1 | 6/2008 | Matsushita et al. | |
| 2008/0180027 | A1* | 7/2008 | Matsushita et al. | 313/634 |
| 2008/0246400 | A1 | 10/2008 | Ito et al. | |
| 2010/0156263 | A1 | 6/2010 | Ito et al. | |

FOREIGN PATENT DOCUMENTS

| | | | |
|---|---|---|---|
| DE | 112005001775 | T5 | 7/2007 |
| DE | 112006001988 | T5 | 7/2008 |
| EP | 0727810 | A2 | 8/1996 |
| EP | 1154462 | B1 | 3/2003 |
| EP | 1335404 | A1 | 8/2003 |
| EP | 1780767 | A1 | 5/2007 |
| EP | 1830390 | A1 | 9/2007 |
| WO | 02/063649 | A2 | 8/2002 |

OTHER PUBLICATIONS

Office Action Issued Sep. 25, 2009 in DE Application No. 102008062410.1.

* cited by examiner

CATHODE SHIELDING FOR DEUTERIUM LAMPS

CROSS-REFERENCE TO RELATED APPLICATIONS

This application is a Section 371 of International Application No. PCT/EP2009/008077, filed Nov. 13, 2009, which was published in the German language on Jun. 24, 2010, under International Publication No. WO 2010/069439 A1 and the disclosure of which is incorporated herein by reference.

BACKGROUND OF THE INVENTION

The invention relates to a gas-discharge lamp, in particular a deuterium lamp, having a housing base made of an insulating material.

In the deuterium lamps used most often today, the cathode is surrounded by a metal housing, which lies at the same potential as the anode space and the molded body. This results in secondary discharges developing, which lead to metal-coating in the case of translucent lamps. The secondary discharge has the further effect that molded body erosion takes place and the intensity of the lamp decreases, because the discharge current can no longer flow completely through the molded body.

In the known deuterium lamps the housing consists of a total of six parts, which all carry tolerances and must be welded to each other. Because the tolerances add up independently, the spread in standard factory models is disproportionately large, especially in the front housing part. Such deuterium lamps further require a high expenditure of time for the assembly. Here, both the front and also the rear housing part are made of metal, wherein the two housing parts are usually connected by a metallic intermediate wall. The cathode is surrounded by the housing front and the cathode window, which are mounted on the intermediate wall. The cathode window and the molded body are thus connected to each other in a conductive way due to the construction. This allows the molded body and the cathode window to lie at the same potential which is lower, however, than the plasma potential at the location of the molded body. This has the result that positive ions are accelerated from the plasma onto the molded body and contribute to its abrasion. Through this form of sputtering, the diameter of the aperture increases and the electrode density in the aperture decreases, whereby the lamp loses UV intensity and the abraded material of the molded body settles on the inside of the bulb and thus results in a reduction of the intensity of the lamp.

German published patent application DE 199 01 919 A1 describes a miniature deuterium arc lamp. The deuterium arc lamp has a construction that is mounted on the distal end of the electrical conductor in an elongated glass bulb at a spacing from the glass bulb, wherein the spacer devices, which engage with the configuration and are arranged at a small distance relative to the bulb, are provided for limiting the transverse movement of the construction in the bulb. Here, the anode is arranged transverse by a dielectric lying in-between at a spacing from a conductive sheet.

Spacer devices fix the anode, the conductive sheet, and the dielectric lying in-between, which were installed in a self-supporting manner on the end of the conductor in previously known deuterium lamps.

European patent application publication EP 0 727 810 A2 describes a gas-discharge tube having a focusing support element of an insulator, wherein the focusing electrode support element has a front surface and a rear surface opposite the front surface, with a thermionic cathode for the emission of thermionic electrons, wherein the cathode is located on the front surface side of the focusing electrode support element; an anode for receiving the thermionic electrons, which the thermionic cathode emits, wherein the anode is located on the rear surface side of the focusing electrode support element and is opposite an opening of the passage hole; a focusing electrode supported by the focusing electrode support element, which is provided by a focusing opening located at a position of an opening of the passage hole for convergence paths of the thermionic electrodes; a spacer between the focusing electrode support element and the anode, which contacts both the rear surface of the focusing electrode support element and also a front surface of the anode; and an anode support element of an insulator, wherein the anode support element is located on an opposite side of the focusing electrode support element by the anode and has a surface that contacts the rear surface of the anode, in order to push the anode onto the rear surface of the focusing electrode support element by the spacer, whereby an interval is fixed between the focusing electrode and the anode of the electrode support element and the spacer.

When a discharge occurs in such a gas-discharge tube among the thermionic cathode, the focusing electrode, and the anode, the anode generates heat after receiving the thermionic electrons, and the focusing electrode also generates heat after bombardment with cations.

German published patent application DE 11 2005 001 775 describes a gas-discharge tube in which a sealed container, an anode and a cathode are provided, and a conductive part that limits a discharge path, wherein the conductive part is arranged between the anode and the cathode and reduces the discharge path formed between the anode and the cathode. Furthermore, the gas-discharge tube has a cathode cover, which is made of ceramic and encloses the cathode. In this gas-discharge tube, as in DE 11 2005 001 775, the cathode cover is encased by the cathode-side cover section, in which only the slot for the emission of electrons is provided as the necessary minimal opening. In this way, the heat-retention effect of the cathode is remarkably maintained by the cathode-side cover section, and the energy consumption is reduced. The ceramic housing thus serves for maintaining the heat within the cathode space.

The discharge lamps described here have the consequence, among other things, that secondary discharges arise, and thus molded body erosion takes place on the aperture. This has the result that the intensity and the service life of the gas-discharge lamp are significantly reduced. Furthermore, the discharge lamps described above are complicated in their assembly.

BRIEF SUMMARY OF THE INVENTION

The object of the invention is therefore to provide a gas-discharge lamp, which has reduced molded body erosion and thus a reduction of the production variation and thus generates an increase in the intensity and the service life and thus avoids the disadvantages named above.

The gas-discharge lamp according to the invention comprises a lamp bulb filled with gas, an anode arranged within the lamp bulb, a cathode arranged at a spacing from the anode within the lamp bulb, and also a housing having a molded body, a housing rear wall, and also a housing base made at least partially of an electrically non-conductive material, wherein the housing base has a housing front, a housing intermediate wall, and a cathode space, and a cathode shielding window, wherein the cathode shielding window is insulated relative to the housing base and/or is made of an insulating material.

Thus, in such a gas-discharge lamp, the metallic cathode window and the molded body are no longer conductively connected to each other. Therefore, the conductive connection is prevented between the cathode shielding window and molded body, which leads to a stable UV intensity of the lamp, because the molded body erosion generated by sputtering effects is avoided. Furthermore, an increase in the UV output is to be noticed, as well as a reduction of the production variation.

In one advantageous embodiment, the invention provides that the molded body is made of a refractory metal, in particular made of molybdenum. This is advantageous, because between the cathode and anode a discharge is formed that delivers a continuous UV spectrum. For increasing the UV intensity, the discharge is narrowed by the molded body, whereby the charge carrier concentration in the inside of the molded body is greatly increased and a point-like light source is generated. By increasing the charge carrier concentration, the gas temperature likewise increases, which brings with it a strong thermal loading of the molded body. By the production of the molded body from a refractory metal, it can withstand such thermal loading.

Advantageously, the housing base involves a housing base that comprises a ceramic and/or a quartz. Such a housing base thus comprises an electrically non-conductive material and thus insulates the cathode window electrically relative to the molded body. This has the result that a conductive connection cannot be realized between the cathode window and molded body due to the potential difference in the plasma, leading to a secondary current from the cathode window via the intermediate wall to the molded body. Such a secondary current would lead to a loss in intensity in the UV range, because the current is no longer available for the discharge. Furthermore, such a current would also influence the widening of the molded body over the service life of the lamp. With a housing base as described above, which comprises a ceramic and/or a quartz, such a secondary current can be prevented, as well as the effects resulting therefrom. Thus, a significant increase in intensity, as well as an increase in the service life of the deuterium lamp is achieved.

In one advantageous embodiment, the invention provides that the housing base comprises a housing front and a housing intermediate wall, as well as a rear housing wall, made of nickel. Such a construction of a deuterium lamp requires a simple assembly of the lamp, as well as a reduction of the components, whereby cost savings in the production of the deuterium lamp is likewise given.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
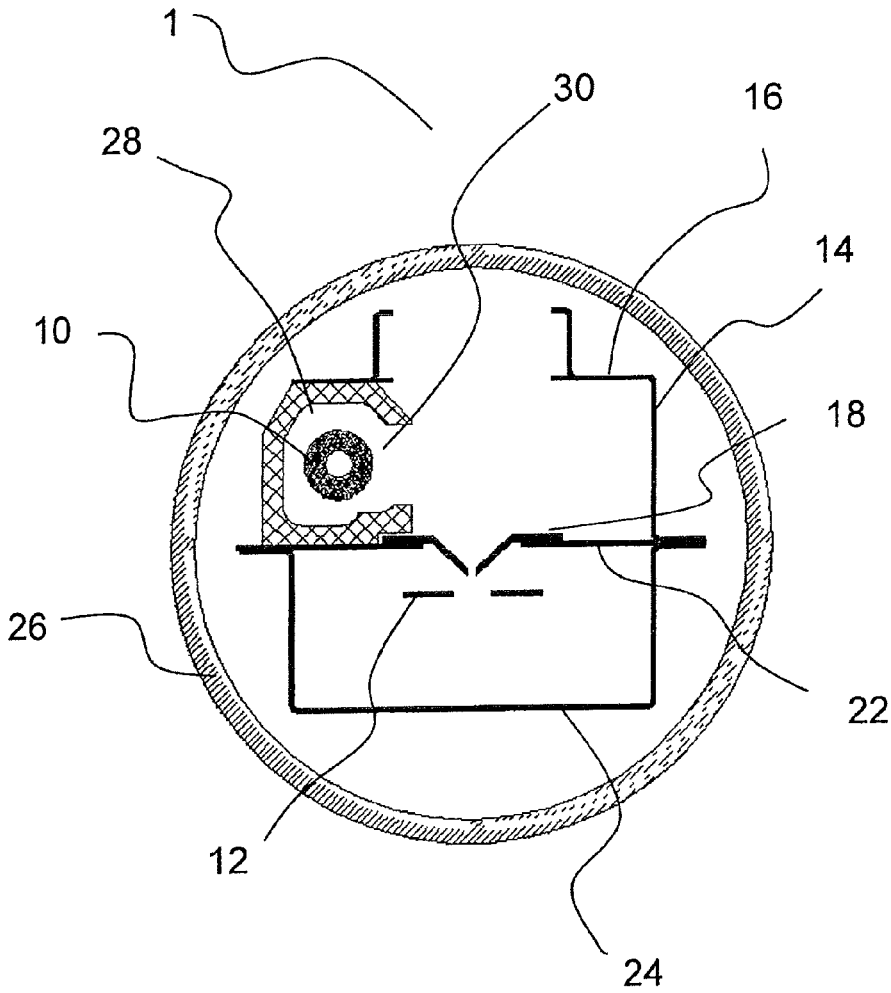
FIG. 1 is a cross-sectional view of a deuterium lamp according to an embodiment of the invention having a ceramic cathode space.

In FIG. 1 a deuterium lamp 1 is shown having a cathode space 28, which completely surrounds the cathode 10. The cathode space 28 is part of the housing base 14, which comprises, among other things, a housing front 16 and an intermediate housing wall 22. Furthermore, within the deuterium lamp 1 there is a cathode 10 and also an anode 12. During operation of the deuterium lamp 1, a discharge forms between the cathode 10 and also the anode 12, which discharge delivers a continuous UV spectrum. For increasing the UV intensity, the discharge is narrowed by the molded body 18. In this way, the charge carrier concentration inside the molded body 18 is significantly increased and produces a point-shaped light source.

The cathode 10 is surrounded by a cathode space 28, wherein the cathode space 28 has a circular opening in the direction of the optical axis of the deuterium lamp 1, which opening forms the cathode window 30. The optical axis is here defined by the openings in the molded body 18 and in the anode 12. Through the cathode window 30, the discharge path is bent at a right angle to the optical axis. The cathode window 30 therefore has the object of defining the discharge path and is located in direct contact with the plasma within the deuterium lamp 1.

The cathode space 28 comprises an electrically non-conductive material and thus insulates the cathode window 30 relative to the molded body 18. This arrangement avoids the conductive connection between cathode window 30 and molded body 18, which was formed due to the potential difference in the plasma and would lead to an electrical secondary current from the cathode window 30 via the housing base 14 to the molded body 18. Such a secondary current leads to a loss in intensity, because the current is no longer available for the discharge and causes, among other things, also a widening of the molded body 18 over the service life of the lamp, because this acts as a sort of auxiliary cathode and is sputtered by positively charged particles from the plasma. The ceramic cathode space is fixed with two rivets to the intermediate wall and to the housing front 16. The fastening by rivets offers mechanical stability with simultaneously high precision. This guarantees an exact spacing between cathode window 30 and molded body 18. The rest of the components of the deuterium lamp 1 are made of metal and are welded to each other, in order to likewise achieve increased stability.

Figure 2:
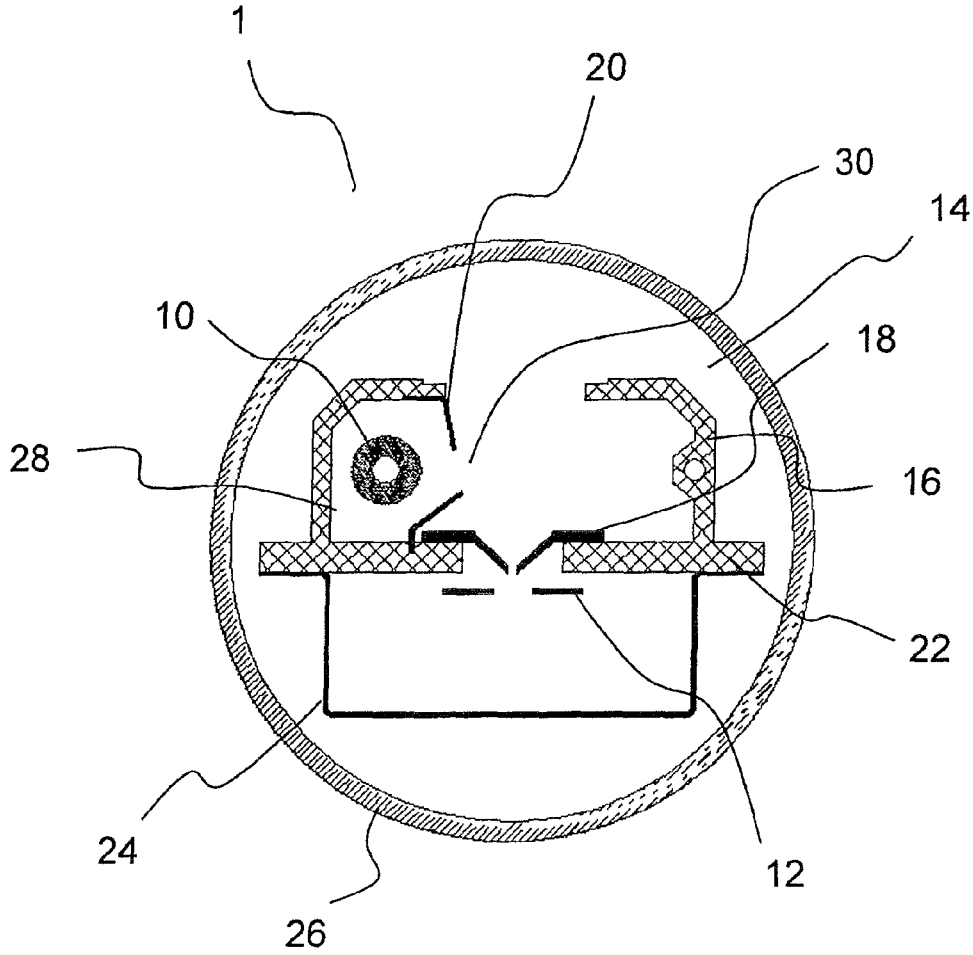
FIG. 2 is a cross-sectional view of a deuterium lamp according to another embodiment of the invention having a housing base made of ceramic.

In FIG. 2 a deuterium lamp 1 is shown having a housing base 14 made of ceramic. The deuterium lamp 1 comprises, among other things, an air-tight bulb 26 and also a housing base 14. The bulb 26 is here filled with gas, here deuterium. The housing, which also comprises the housing base 14, further comprises, among other things, cathode 10, anode 12, molded body 18, a cathode shielding window 20, and also a housing rear wall 24. The housing base 14 is made of an insulating material, in this case ceramic. During operation of the here-constructed deuterium lamp 1 shown, a discharge forms between the cathode 10 and the anode 12, which discharge delivers a continuous UV spectrum. For increasing the UV intensity, the discharge is narrowed by the molded body 18. In this way, the charge carrier concentration inside of the molded body 18 is greatly increased and a point-shaped light source is generated, as is needed for many applications. An increase in the charge carrier concentration has the effect that the gas temperature rises and the molded body 18 is strongly thermally loaded. Therefore, the molded body 18 is made of a refractory metal, here molybdenum.

In FIG. 2 the housing front 16 and the housing intermediate wall 22 are assembled into a component that forms the housing base 14. This has the effect that the assembly of the housing front and the housing intermediate wall 22 is significantly reduced by the reduction of the components and better reproducibility in the assembly of the parts is guaranteed, because these two parts are assembled as one component.

The cathode space 28 is formed in FIG. 2 by the housing base 14 and the cathode shielding window 20 that surround the cathode 10. Here, the cathode shielding window 20 has a slot-shaped opening in the direction of the optical axis of the deuterium lamp 1, the so-called cathode window. The optical axis of the deuterium lamp is defined by the opening in the molded body 18 and in the anode 12. Through the cathode window 30, the discharge path is bent at a right angle to the optical axis. Thus, the cathode window 30 has the object of defining the discharge path and is therefore in direct contact with the plasma. The cathode window 30 is made of metal, because it must withstand the reactive plasma.

In order to insulate the cathode window 30 electrically relative to the molded body 18, the housing base 14 is made of an electrically non-conductive material. In this way, a conductive connection is avoided between the cathode window 30 and molded body 18, which would lead, due to the potential difference in the plasma, to an electrical secondary current from the cathode window 30 via the intermediate wall to the molded body 18. Such a secondary current leads namely to a loss in intensity in the UV range, because the current is no longer available for the discharge, and also has the result that a widening of the molded body 18 takes place over the service life of the lamp, because the molded body 18 acts as a sort of auxiliary cathode and is sputtered by positively charged particles from the plasma. This effect is promoted by the high temperature of the molded body 18, because a high temperature reduces the binding energy of the surface anatomy. The deuterium lamp shown in FIG. 2 prevents this secondary current and the disadvantageous effects resulting therefrom with respect to the intensity and the service life of the deuterium lamp.

The cathode shielding window 20 is led into the intermediate wall through a slot-shaped aperture and attached in a stable way to the housing front 16 by two rivets. As a whole, the molded body 18 is attached to the housing intermediate wall 22 by a total of four rivets. The slot-shaped aperture defines exactly the position of the cathode shielding window 30 and its spacing from the molded body 18. The riveted connection provides for small tolerances and high mechanical stability, which is particularly necessary for a stable UV intensity.

The cathode 10 is held directly in the drill hole on the opposite side of the cathode space in the housing base 14 and no longer needs to be insulated by an additional component. This prevents additional tolerances from arising. Furthermore, the position of the cathode is thus also defined and maintained more exactly.

The rear wall is likewise attached to the opposite side of the housing intermediate wall 22 with four rivets. Due to the simplified construction of the deuterium lamp 1 in FIG. 2, production tolerances are reduced, and cost savings are realized simultaneously by shortening the production time.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A gas-discharge lamp comprising:

a lamp bulb filled with gas;

an anode arranged inside the lamp bulb;

a cathode arranged spaced from the anode inside the lamp bulb;

a housing having a molded body, a housing rear wall made of a metal, and a housing base and made at least partially of a non-conductive material, wherein the housing base has a housing front, a housing intermediate wall, and a cathode space; and a cathode shielding window, wherein the cathode shielding window is insulated relative to the molded body and housing rear wall and/or comprises an insulating material.

2. The gas-discharge lamp according to claim 1, wherein the molded body is made of a refractory metal.

3. The gas-discharge lamp according to claim 2, wherein the refractory metal comprises molybdenum.

4. The gas-discharge lamp according to claim 1, wherein the molded body is insulated relative to the housing rear wall.

5. The gas-discharge lamp according to claim 1, wherein the gas comprises deuterium.

6. The gas-discharge lamp according to claim 1, wherein the housing base comprises a ceramic.

7. The gas-discharge lamp according to claim 1, wherein the housing base comprises quartz.

8. The gas-discharge lamp according to claim 1, wherein the cathode shielding window comprises a metal.

9. The gas-discharge lamp according to claim 1, which is adapted for application for analytical purposes.

* * * * *